US009145024B2

(12) United States Patent
Tragatschnig

(10) Patent No.: US 9,145,024 B2
(45) Date of Patent: Sep. 29, 2015

(54) FLEXIBLE HOUSING, IN PARTICULAR FOR WRITING IMPLEMENTS, AND METHOD FOR PRODUCING A FLEXIBLE HOUSING

(71) Applicant: PORSCHE LIZENZ UND HANDELSGESELLSCHAFT MBH & CO. KG, Bietigheim-Bissingen (DE)

(72) Inventor: Joerg Tragatschnig, Zell am See (AT)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 70 days.

(21) Appl. No.: 13/706,410

(22) Filed: Dec. 6, 2012

(65) Prior Publication Data

US 2013/0156977 A1 Jun. 20, 2013

(30) Foreign Application Priority Data

Dec. 19, 2011 (DE) ..... 10 2011 056 592

(51) Int. Cl.

| | |
|---|---|
| ***B43K 23/00*** | (2006.01) |
| ***B65D 13/00*** | (2006.01) |
| ***B65D 23/08*** | (2006.01) |
| ***B43K 7/00*** | (2006.01) |

(52) U.S. Cl.

CPC ..... *B43K 23/00* (2013.01); *B43K 7/005* (2013.01); *B65D 13/00* (2013.01); *B65D 23/08* (2013.01); *Y10T 29/49826* (2015.01); *Y10T 428/13* (2015.01)

(58) Field of Classification Search

CPC ..... B43K 24/00; B43K 24/04; B43K 24/06; B65D 13/00; B65D 23/08; Y10T 29/49826; Y10T 428/13

See application file for complete search history.

(56) References Cited

U.S. PATENT DOCUMENTS

| | | | | |
|---|---|---|---|---|
| 2,515,366 A | | 7/1950 | Zublin | |
| 3,260,241 A | | 7/1966 | Bross | |
| 4,022,535 A | | 5/1977 | Ritter | |
| 4,459,056 A | * | 7/1984 | Getgey et al. | 401/50 |
| 4,917,518 A | * | 4/1990 | Chern | 401/65 |
| 5,807,241 A | | 9/1998 | Heimberger | |

FOREIGN PATENT DOCUMENTS

| | | |
|---|---|---|
| DE | 25 19 212 | 11/1976 |
| DE | 37 32 027 | 4/1989 |
| DE | 195 35 179 | 3/1997 |

OTHER PUBLICATIONS

German Search Report of Jul. 27, 2012.

* cited by examiner

*Primary Examiner* — Michael C Miggins

(74) *Attorney, Agent, or Firm* — Gerald E. Hespos; Michael J. Porco; Matthew T. Hespos

(57) ABSTRACT

A flexible housing is provided for writing implements or for other articles of everyday use, such as bottles, lighters, etc. The housing has at least one separating point to provide a flexible housing that can move independently of the elastic properties of the base material used. The elements of the housing that are separated by the separating point are connected to one another in a form-fitting manner, and the form-fitting region has play. As a result, the housing can move, and the extent of movement is determined by the sum of the selected plays over all separating points. The ability of the housing to move allows an interaction between the housing and the article received by the housing, i.e. a movement of the housing acts on the article received and can produce a desired function (moving a pen refill, producing a flame, ejecting liquid, etc.).

11 Claims, 3 Drawing Sheets

FLEXIBLE HOUSING, IN PARTICULAR FOR WRITING IMPLEMENTS, AND METHOD FOR PRODUCING A FLEXIBLE HOUSING

CROSS REFERENCE TO RELATED APPLICATION

This application claims priority under 35 USC 119 to German Patent Appl. No. 10 2011 056 592.2 filed on Dec. 19, 2011, the entire disclosure of which is incorporated herein by reference.

BACKGROUND OF THE INVENTION

1. Field of the Invention

The invention relates to a flexible housing, in particular for writing implements, but also for other articles of everyday use, such as bottles, lighters, etc.

2. Description of the Related Art

Housings that are intended to receive and protect an article must be strong. Some housings also must permit a predetermined flexibility or movability, and such movements should interact with the protected article. For example, a writing implement, such as a ballpoint pen, has a housing that receives a ballpoint refill and a latching mechanism. The housing is movable, for example, in the longitudinal or rotational direction to actuate the latching mechanism. As a result, the ballpoint pen refill can be moved out of the housing and back. A lighter, on the other hand, has a fuel container and an ignition and valve mechanism arranged inside a housing. A predetermined movability releases the ignition and valve mechanism. Bottles may have a liquid container and a pump mechanism. The pump mechanism is actuated by a movement of the housing, for example, by moving a push-button inside the housing.

U.S. Pat. No. 2,515,366 relates to drill strings and subdivides a pipe into segments that are coupled together again via form-fitting connections, such as dovetail connections. In each case, three projections of each segment, i.e. six projections per parting plane, preferably are intended to inter-engage in each parting plane. More projections could be provided, but would offer no advantage for the intended application. Nothing is accommoded in the pipe. Rather, a drill string is provided which, on the one hand, resists high loads during drilling and, on the other hand, is flexible enough to allow a diverging drilling direction.

DE 195 35 179 A1 discloses a tubular shaft for a flexible endoscope that is divided into a plurality of tube sections that can be angled away. Form-fitting connections are defined at the peripheral separating joints between the tube sections. In this way, good mobility of the tube is provided in all directions combined with a form-fitting connection. The tube should be designed to be angled away and to be rotated in the angled-away state. The tube receives the light guide of the endoscope, but does not interact therewith. Rather, the tube functions only for protection and mechanical stabilization.

DE 37 32 027 A1 shows a writing implement with a housing that has at least one elastic section for actuating a switching and latching mechanism in the housing to advance and retract the writing medium carrier (ballpoint pen refill). For this purpose, slots are incorporated in various arrangements into the plastic or metal housing and can be deformed in the actuating direction.

It is the object of the invention to provide a flexible housing that can move independently of the elastic properties of the base material and that allows an interaction with the article received by the housing.

SUMMARY OF THE INVENTION

The invention relates to a housing that can be moved along a first axis and has at least one separating point perpendicular to the first axis. The separating point runs completely or at least substantially around the periphery of the housing. The housing has two elements that are separated by the separating point. However, the housing has at least one region in which the two elements that are separated by the separating point are connected to one another in a form-fitting manner. The form-fitting region has play in the direction of the axis. The play in the form-fitting connection enables the housing to move, and the extent of the movement is determined by the sum of the selected plays over all separating points. The ability to move is based on a form fit. Thus, the elastic properties of the base material do not play any role and the geometric configuration of the form-fitting region can be selected freely independently of the elastic properties of the base material and according to design considerations. This additional degree of freedom offers a large advantage since the housing defines the outer appearance of the article and therefore is influenced decisively by design considerations. The ability of the housing to move allows an interaction between the housing and the article received by the housing, i.e. a movement of the housing acts on the article received and can produce the desired function (moving a pen refill, producing a flame, ejecting liquid, etc.).

The separating point should be formed substantially from regions connected in a form-fitting manner. In this case, one form-fitting region adjoins the next in the separating point. Thus, a particularly high stability advantageously is achieved since the elements of the housing that are separated by the separating point are connected peripherally to one another in a form-fitting manner at plural support points.

Each of the form-fitting regions preferably is arranged in mirror-image fashion in the plane of the separating point so that form-fitting regions situated next to one another each point in different directions. Consequently, it is possible to arrange the form-fitting regions tightly next to one another to achieve a separating point formed only of regions connected in a form-fitting manner.

The form-fitting regions may have dovetail profiles. These profiles can be produced easily and the necessary play can be created simply by an end-side gap. The lateral surfaces of the dovetail profile that extend obliquely inside one another ensure a high stability in the applied state, i.e. in the extended state of the housing. At the same time, dovetail profiles are particularly well suited to producing mirror-image profiles since a dovetail profile can be constructed mirror-symmetrically.

At least one spring may be inside the housing to apply the prestress in the direction of the first axis. The housing of the invention does not have its own elasticity. Thus, the extended state of the housing must be produced by spring force. From this basic state, the housing then is deformed by actuation by the user counter to the spring force. The spring can be separate in a known manner (like the spring in a ballpoint pen that acts on the ballpoint pen refill) or advantageously can be a constituent part of the article received by the housing, for example the ignition and valve mechanism of a lighter.

At least one guide element may be inside the housing and may be active in the direction of the first axis. The housing also may be flexible or movable outside of the intended direction, here the direction of the first axis, at any rate when the extended state of the housing is left. The guide element can ensure stability outside the direction of the first axis and may be designed in a known manner, for example as a telescopic guide. The guide element can be arranged inside the spring element in a space-saving manner.

The invention also relates to a method for producing a housing that can be moved along a first axis. The method includes providing a blank of a solid base material that already has substantially the shape of the final housing. The method then includes severing the blank peripherally or substantially peripherally perpendicularly to the first axis in such a way that at least one region connected in a form-fitting manner is formed along the separating point. The method also includes incorporating gaps into the form-fitting region to create a play in the direction of the first axis.

The method preferably includes bringing the housing largely into its final shape before the incorporation of the separating points. In this way the deformation and forming operations necessary for this purpose can be carried out on an integral workpiece without having to take account here of separating points.

The separating points can be produced by a laser beam or by a water jet. These methods do not deform the base material. As a result, the external shape of the housing is not changed during severing. At the same time, both methods produce burr-free cuts so that no complicated finishing is necessary in the region of the separating points.

The invention is explained in more detail below with reference to the exemplary embodiment illustrated in the figures.

DETAILED DESCRIPTION OF THE PREFERRED EMBODIMENTS

Figure 1:
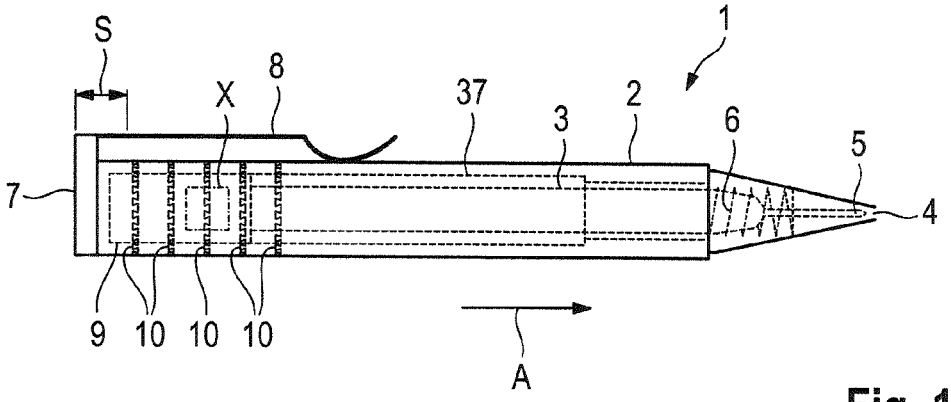
FIG. 1 shows a ballpoint pen having a flexible housing according to the invention.

The ballpoint pen 1 shown in FIG. 1 has a housing 2 inside which an article, here a ballpoint pen refill 3, is held. The housing 2 has an opening 4 through which a tip 5 of the ballpoint pen refill 3 can pass and a spring 6 is arranged adjacent to the opening 4. The rear end 7 of the housing 2 opposite the opening 4 bears a clip 8 so that the ballpoint pen 1 can be able held on items of clothing, for example. A latching mechanism 9 is held on the rear end 7 in the housing 2 and interacts with the ballpoint pen refill 3 in the axis direction A.

Separating points 10 are provided around the periphery of the housing 2 adjacent the rear end 7 of the housing 2. The separating points 10 subdivide the housing into a plurality of elements 11.

A sleeve 37 is connected fixedly connected to the tip 5 and is guided in an annular receptacle (not shown) in the latching mechanism 9. The sleeve 37 and the latching mechanism 9 form a telescopic guide element that guides the rear end 7 and the tip 5 relative to one another in the axis direction A.

Figure 2:
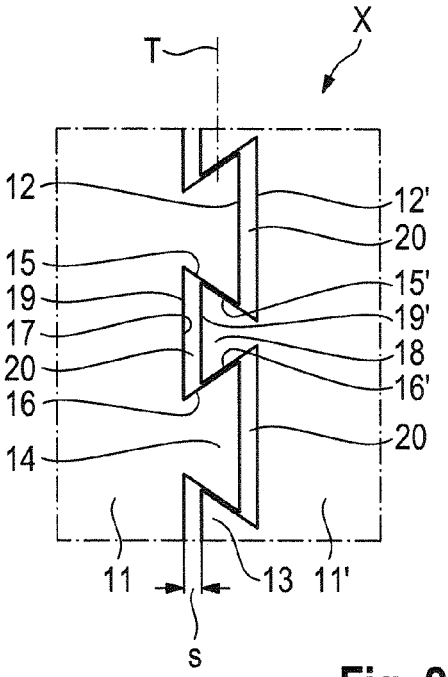
FIG. 2 shows a detail X of FIG. 1 in an enlarged view and in the extended state.

FIG. 2 illustrates in greater detail a separating point 10 in the extended state of the housing 2, i.e. in its maximum length extension. The separating point 10 subdivides the housing 2 into two elements 11 and 11' along a separating plane T that extends perpendicularly to the axis A. The elements 11 and 11' are formed so that mutually opposite edges 12 and 12' are parts of form-fitting dovetail connections 13 and 14. The dovetail connections 13 and 14 are substantially mirror-images with the dovetail connection 13 pointing left in the illustration and the dovetail connection 14 pointing right.

The dovetail connection 13 is formed by corresponding edges on the elements 11 and 11'. Lateral edges 15 and 16 on the first element 11 form a recess 17 that accommodates a lug 18 formed by corresponding lateral edges 15' and 16' on the second element 11'. The edges 15, 15' and 16, 16' extend toward one another in the direction of the axis A so that the lug is captured in the recess to form a form-fitting connection of the elements 11 and 11'. The corresponding side walls 15 and 15' and 16 and 16' bear against one another when the housing 2 is in the extended state.

An end edge 19 on the first element 11 extending on the end of the dovetail connection 13 in the direction of the separating plane T and a corresponding edge 19' on the second element 11' are arranged with a play s relative to one another so that a gap 20 can be provided between the elements 11 and 11' when the housing 2 is in the extended state illustrated in FIG. 2. All of the dovetail connections 13, 14 have gaps 20 of equal size. The dovetail connections 14 adjoining the illustrated dovetail connection 13 are constructed in the same way, with the lateral edges 15, 15', 16, 16' each simultaneously also being part of the adjacent dovetail connections 14.

Figure 3:
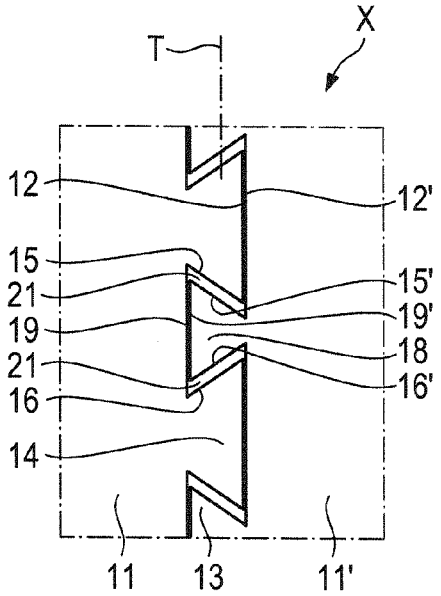
FIG. 3 shows the detail X as shown in FIG. 2 in the compressed state.

FIG. 3 shows the same detail of the housing 2, but in the compressed state of the housing 2 in which the latter has its minimum length extension. Here, the gaps 20 are closed, i.e. the end edges 19 and 19' bear against one another. However, lateral gaps 21 now are formed between the lateral edges 15, 15' and 16, 16'.

The gaps 20 in the extended state or the lateral gaps 21 in the compressed state enable the elements 11, 11' to be moved with respect to one another by the play s in the region of the separating point 10. The plays s of all of the separating points 10 of the housing 2 add up over the entire housing 2 to a travel distance S of the housing 2 in the axis direction A. Consequently, the rear end 7 can be actuated to move by the travel distance S and can act on the latching mechanism 9 so that the ballpoint pen refill 3 is displaced against the force of the spring 6. Thus, the tip 5 passes through the opening 4 in the housing and the ballpoint pen 1 is ready for writing. The spring 6 moves the housing 2 again into its extended state if the rear end 7 is relieved again. With a renewed actuation of the rear end 7, the latching mechanism 9 is actuated a further time so that, after the rear end 7 has been relieved, the tip 5 is retracted again through the opening 4 in a known manner and the ballpoint pen 1 is no longer ready for writing. In this way, an interaction is made possible between the housing 2 and the ballpoint pen refill 3 and the latching mechanism 9 or other article received by the housing.

Figure 4:
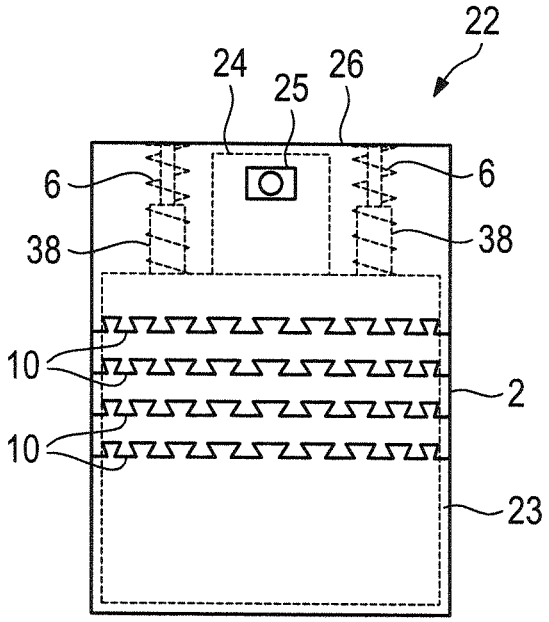
FIG. 4 shows a bottle having a flexible housing according to the invention.

FIG. 4 shows the invention applied to a bottle 22 for perfumes or the like. The bottle 22 has a housing 2 that receives a liquid container 23 and a pump mechanism 24. Liquid can be dispensed from the container 23 through a window 25 in the housing 2 as a spray burst from the pump mechanism 24. The pump mechanism 24 is actuated by compressing the housing 2 in the axis direction A by the travel distance S, with an upper end 26 of the housing 2 acting on the pump mechanism 24. Two springs 6 return the housing 2 to its extended position when the upper end 26 is relieved. Movability of the housing 2 is achieved by separating points 10 arranged perpendicular to the axis direction A. Each separating point has the play s and the sum of the plays s produces the travel S.

A telescopic pin 38 is arranged inside each spring 6 and has one fixedly connected to the liquid container 23 and the other end to the upper end 26. The telescopic pins 38 guide the end 26 in the axis direction A since the liquid container 23 is held fixedly in the lower part of the housing 2. In this way, an interaction is made possible between the housing 2 and the pump mechanism 24 or other article received.

Figure 5:
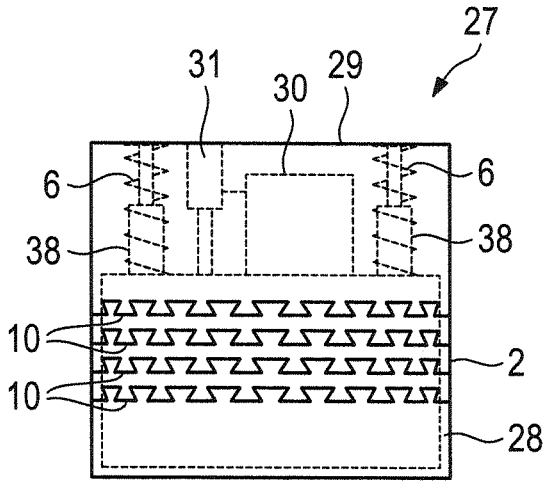
FIG. 5 shows a lighter having a flexible housing according to the invention.

FIG. 5 shows the invention applied a lighter 27 that has a housing 2 with separating points 10 incorporated perpendicular to the axis direction A. The sum of the plays s in the separating points 10 again produces a travel S by which an upper end 29 of the housing 2 can be moved. The upper end 29 is held by the spring 6 in the illustrated extended position of the housing 2. A load on the upper end 29, for example by thumb pressure, displaces the upper end 29 by the travel S and acts on an ignition and valve mechanism 30 to let gas out of a container 28 through a burner nozzle 31 and ignites it, resulting in a flame (not shown). In this way, an interaction is made possible between the housing 2 and the ignition and valve mechanism 30 or other article received therein.

A telescopic pin 38 is arranged inside each of the springs 6 and has one end fixedly connected to the container 28 and the other end to the upper end 29. The telescopic pins 38 guide the end 29 in the axis direction A, since the container 28 is held fixedly in the lower part of the housing 2.

Figure 6:
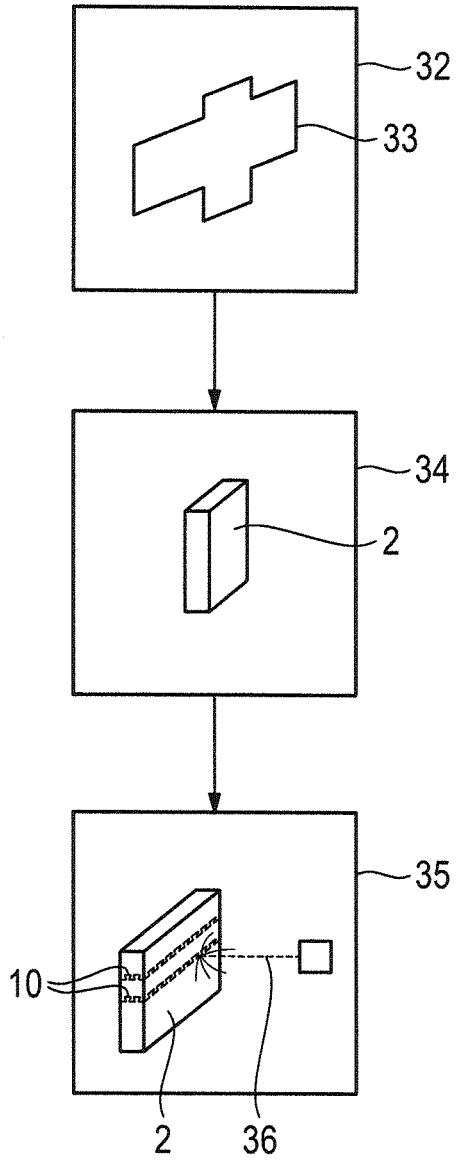
FIG. 6 shows a schematic illustration of a method for producing the flexible housing according to the invention.

A method for producing the housing 2 is illustrated in FIG. 6. In a first step 32, a plate-shaped starting material 33 is provided in the necessary geometry. In the following second step 34, which can consist of a plurality of substeps, a closed housing 2 is formed from the starting material 33 in a known manner. The sub-steps can comprise bending, buckling, folding, deep-drawing, hydroforming, etc. to form the basic shape of the housing 2. A plurality of individual parts can be connected to one another by crimping, welding, soldering, etc. The separating points 10 and the gaps 20 then simultaneously are incorporated into the housing 2 in a third step 35. For this purpose, use is made in the exemplary embodiment of a laser beam 36 by means of which the edges 12 can be produced very substantially free from burrs.

What is claimed is:

1. An extendable and contractible housing, comprising:

a first section extending longitudinally along an axis and having opposite first and second ends spaced apart along the axis, a plurality of first trapezoidal projections at the first end of the first section in an axial direction and spaced from one another in a direction transverse to the axial direction, each of the first trapezoidal projections having opposite side edges and a distal edge extending between the side edges, each of the first trapezoidal projections being gradually wider at positions closer to the distal edge, first trapezoidal recesses being defined between the first trapezoidal projections;

a second section extending longitudinally along the axis and having opposite first and second ends, a plurality of second trapezoidal projections at the second end of the second section in the axial direction and spaced from one another in the direction transverse to the axial direction, each of the second trapezoidal projections having opposite side edges and a distal edge extending between the side edges, each of the second trapezoidal projections being gradually wider at positions closer to the distal edge, second trapezoidal recesses being defined between the second trapezoidal projections, wherein the first trapezoidal projections are engaged respectively in the second trapezoidal recesses and the second trapezoidal projections are engaged respectively in the first trapezoidal recesses, the first and second trapezoidal projections and the first and second trapezoidal recesses being dimensioned to permit limited axial movement of the first section relative to the second section and to prevent separation of the first and second sections.

2. The housing of claim 1, further comprising at least one spring element inside the housing to apply a prestress in the axial direction.

3. The housing of claim 1, further comprising at least one guide element inside the housing in the direction of the first axis.

4. The housing of claim 1, wherein each of the first and second trapezoidal recesses has a base edge, an opening opposite the base edge, and first and second side edges extending obliquely from the base edge to the opening and converging towards each other, a width of the base edge of each of the second trapezoidal recesses being greater than a length of the distal edge of each of the first trapezoidal projections.

5. The housing of claim 4, wherein the distal edges of the first trapezoidal projections contact the base edges of the second trapezoidal recesses when the first and second sections are moved toward one another and into a contracted position.

6. The housing of claim 5, wherein the side edges of the first trapezoidal projections are spaced from the side edges of the second trapezoidal projections when the first and second sections are in the contracted position.

7. The housing of claim 4, wherein the side edges of the first trapezoidal projections contact the side edges of the second trapezoidal projections when the first and second sections are moved away from one another and into an extended position.

8. The housing of claim 7, wherein the distal edges of the first trapezoidal projections are spaced from the base edges of the second trapezoidal recesses when the first and second sections are in the extended position.

9. A pen having a tubular housing, the housing comprising:

a first section having a first axial end with first dovetail projections and first dovetail recesses alternating with one another in a circumferential array around the first axial end of the first section;

a second section having a second axial end with second dovetail projections and second dovetail recesses alternating with one another in a circumferential array around the second axial end of the second section, the first dovetail projections being engaged in the second dovetail recesses and the second dovetail projections being engaged in the first dovetail recesses, the first and second dovetail rejections and the first and second dovetail recesses being dimensioned to permit limited axial movement of the first and second sections toward and away from one another.

10. The pen of claim 9, further comprising a ballpoint pen refill in the housing and a spring element inside the housing to apply a prestress to the refill for urging the first and second sections toward or away from one another.

11. The pen of claim 10, further comprising a latch for releasably holding the first and second sections in a specified axial position relative to one another.

* * * * *